US006662645B2

(12) United States Patent
Brewer

(10) Patent No.: US 6,662,645 B2
(45) **Date of Patent: *Dec. 16, 2003**

(54) APPARATUS AND METHOD FOR MEASURING FORCES ON WELL LOGGING INSTRUMENTS

(75) Inventor: James E. Brewer, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/068,284

(22) Filed: Feb. 5, 2002

(65) Prior Publication Data

US 2002/0124640 A1 Sep. 12, 2002

Related U.S. Application Data

(63) Continuation-in-part of application No. 09/779,238, filed on Feb. 8, 2001.

(51) Int. Cl.[7] ..... E21B 44/00
(52) U.S. Cl. ..... 73/152.48
(58) Field of Search ..... 73/152.02, 152.03, 73/152.46, 152.43, 152.48

(56) References Cited

U.S. PATENT DOCUMENTS

| | | | | |
|---|---|---|---|---|
| 4,125,013 A | | 11/1978 | Nicolas et al. | 73/151 |
| 4,265,110 A | | 5/1981 | Moulin | 73/151 |
| 4,267,727 A | | 5/1981 | Hoppe | 73/151 |
| 4,269,063 A | | 5/1981 | Escaron et al. | 73/151 |
| 4,409,824 A | | 10/1983 | Salama et al. | 73/151 |
| 4,811,597 A | * | 3/1989 | Hebel | 73/152.48 |
| 5,339,679 A | | 8/1994 | Ingram et al. | 73/84 |
| 5,341,886 A | * | 8/1994 | Patton | 175/24 |
| 6,450,022 B1 | * | 9/2002 | Brewer | 73/152.48 |

* cited by examiner

*Primary Examiner*—Max Noori
(74) *Attorney, Agent, or Firm*—Madan, Mossman & Sriram, P.C.

(57) ABSTRACT

A device to monitor and quantify the tension and compression forces acting on a well logging instrument string during deployment. The device eliminates the undesirable effects of downhole hydrostatic pressure on the sensors, and eliminates the need for a costly, complex, and high maintenance hydraulic pressure equalizing system in the force gage assembly. The device provides improved measurement accuracy, provides enhanced reliability and longer life of the sensors, and allows lower cost of manufacture and maintenance.

6 Claims, 6 Drawing Sheets

APPARATUS AND METHOD FOR MEASURING FORCES ON WELL LOGGING INSTRUMENTS

CROSS REFERENCE TO RELATED APPLICATIONS

The present application is a Continuation-in-Part of U.S. patent application Ser. No. 09/779,238 filed on Feb. 8, 2001.

BACKGROUND OF THE INVENTION

1. Field of the Invention

This invention relates to a measuring device and relates in particular to a device for measuring deployment and operating forces on a well logging instrument.

2. Description of the Related Art

In the deployment of well logging instruments and devices in wells, it is desired to remotely monitor and quantify the forces applied to the instrument string by the various deployment means such as wire line/armored cable with or without assistance of well tractor, caterpillar, worm, crawler, mule, or other push/pull devices; pipe conveyed; or coiled tubing conveyed. A downhole force gage is used for sensing and monitoring the forces applied to the instrument string.

Existing downhole force gages, also called cable head tension sensors, typically employ strain gage sensors to monitor the mechanical strains induced by deployment forces. The strain gages are mounted on a high strength body which is housed in a sealed internal cavity of the gage assembly. The strain gages are attached and bonded with adhesive or other techniques to the strain gage body and configured electrically as a balanced bridge circuit. Mechanical strain proportional to the applied tension or compression load is induced into the strain gage body. With the bridge circuit powered by a constant, regulated d.c. voltage (typically 10 volts), the strain gage bridge outputs a signal (typically in millivolts) proportional to the applied loads.

When submerged in a fluid filled borehole, hydrostatic pressure impinges on the downhole instrument string and force gage assembly, and produces an external differential pressure force which acts upon the force gage assembly. These hydrostatic pressure forces induce undesired proportional offsets in the strain gage output, so a pressure equalizing system is utilized to eliminate the effects of hydrostatic pressure.

A typical force gage assembly is configured with a suitable floating piston (or an elastic bellows), and the internal cavity of the assembly is filled with a suitable hydraulic fluid. The floating piston (or elastic bellows) moves to accommodate any changes in the volume of the hydraulic fluid in the internal cavity due to changes in hydrostatic pressure or due to changes in temperature. By this means the internal cavity of the force gage assembly is thus pressure-equalized to external hydrostatic pressure, and also by this means the internal cavity, together with the strain gage bridge circuits and wiring, are protected from direct contact with the borehole fluids.

However, the typical configuration is complex, has relatively high cost of manufacture, has relatively high cost of maintenance, and requires hydraulic fluid filling of the force gage assembly. The strain gages are in contact with hydraulic fluid which can be a path of electrical leakage, and over time the hydraulic fluid can attack and degrade the strain gage adhesive bonds. The strain gages also are exposed to hydrostatic pressure which induces some inaccuracy in the output signal. Therefore, there is a demonstrated need for a force gage that eliminates the effects of downhole pressure while maintaining the sensing elements in a gas filled chamber.

SUMMARY OF THE INVENTION

The present invention addresses the above-noted and other deficiencies in the prior art and provides a downhole force gage for measuring both compression and tension forces on a well logging instrument string.

This invention provides more accurate load measurement by isolating the strain sensing elements from all effects of downhole pressure. The sensing elements are disposed on a load rod and are located in an atmospheric pressure housing. The strain sensing load rod is pressure balanced by suitable selection of multiple seal diameters such that the external pressure loads on the load rod are canceled out essentially eliminating the effects of downhole pressure on the load measurement.

In one aspect of the invention, strain gages are adhesively bonded to the sensing member to form a conventional bridge circuit.

In another embodiment, strain gages are vacuum deposited on the sensing member.

Examples of the more important features of the invention thus have been summarized rather broadly in order that the detailed description thereof that follows maybe better understood, and in order that the contributions to the art may be appreciated. There are, of course, additional features of the invention that will be described hereinafter and which will form the subject of the claims appended hereto.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DESCRIPTION OF THE PREFERRED EMBODIMENTS

Figure 1:
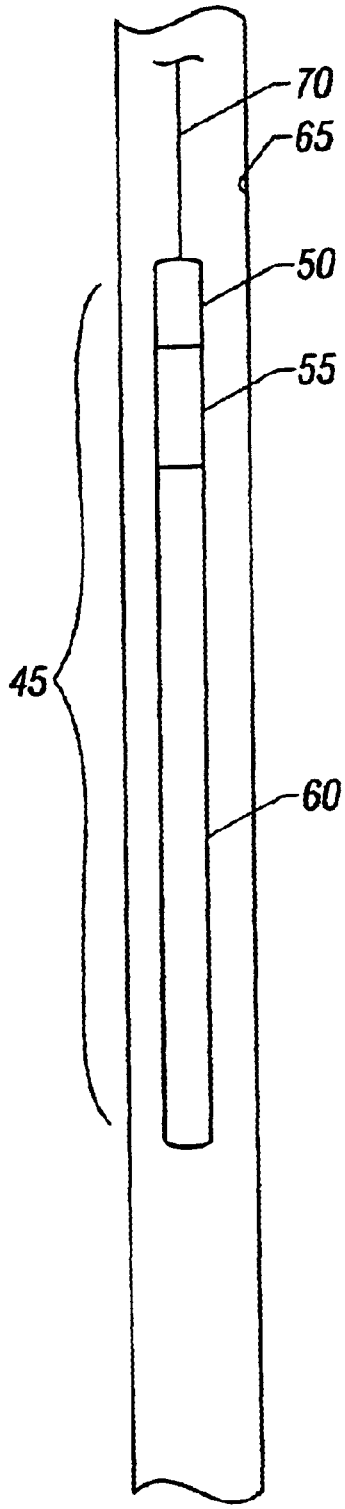
FIG. 1 (Prior Art)
FIG. 1 show a schematic diagram of a well logging instrument being deployed in a wellbore.

FIG. 1 is a schematic showing of a well logging instrument string 45 suspended in a borehole 65 at the end of a braided wireline 70. The braided wireline 70 runs over pulleys (not shown) at the surface and winds on a surface winch (not shown) allowing the instrument string 45 to be moved along the borehole 65. The instrument string 45 comprises a cable head 50 at the top end, which terminates the wireline 70 at the top; a well logging tool 60 at the bottom end;

and, a force sensing instrument 55 disposed between the cable head 50 and the well logging tool 60. When run with wireline as shown in FIG. 1, the force sensing instrument 55 measures the tension force on the instrument string 45. In other deployment configurations (not shown) the instrument string 45 may be run into the borehole 65 using coiled tubing or jointed pipe. In these situations, the force-sensing instrument 55, measures both tension and compression forces on the instrument string 45 as it is pushed into the hole using the coiled tubing or jointed pipe. In addition, certain wireline deployment schemes use devices such as well tractors, crawlers, and other devices to push the instrument string 45 through highly deviated or horizontal boreholes. These pushing devices result in compression forces being imposed on the instrument string 45.

Figure 2:
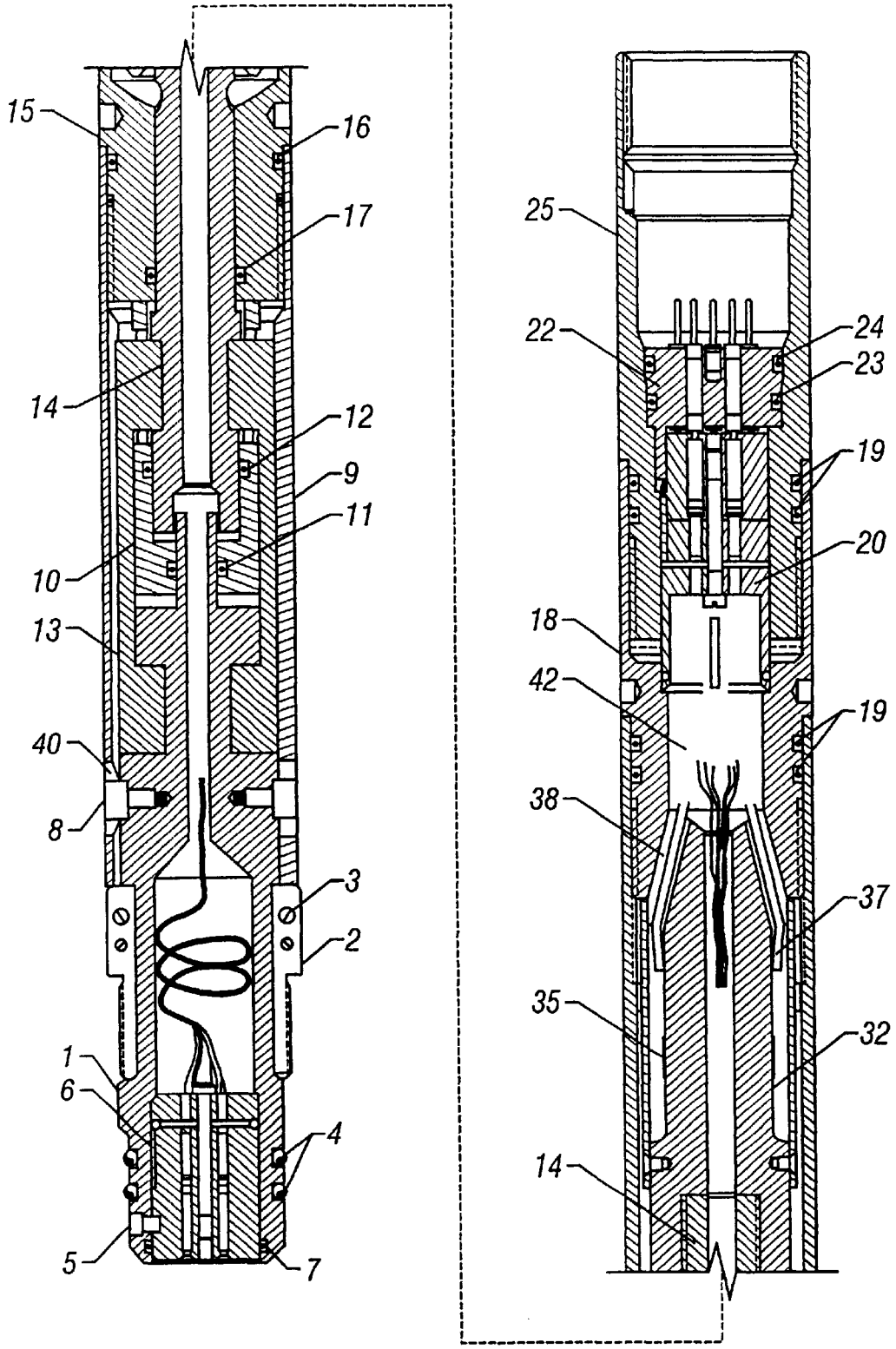
FIG. 2 shows a schematic diagram of a load measuring tool according to one embodiment of the present invention.

FIG. 2 is a schematic of the force-sensing instrument 55. The lower sub 25 is threadably adapted on its lower end to connect to the well logging instrument 60. A connector 22 is mounted in lower sub 25 and provides electrical connection to a mating connector in the logging instrument 60. Alternatively, the connector 22 may include provision for both electric wire and optical fiber connections. The connector 22 has typical o-ring seals 23 and 24 to seal the lower end of sub 25 against wellbore fluid intrusion. The upper end of lower sub 25 is threadably adapted to connect to strain gage sub 18. O-rings 19 seal out wellbore fluid in the connection. Strain gage sub 18 has a reduced cross-section 32 on which strain gages 35 are disposed in a standard strain gage bridge arrangement. Strain gages 35 may be bonded gages or vapor deposited gages. Both methods are known in the art and are not described herein. Wires (not shown) from the strain gages 35 are fed through holes 37 and 38 and fed to the connector 22.

The strain gage sub 18 is coupled with threads to a lower housing 15, and the coupling joint is sealed with o-rings 19. Lower housing 15 has a large internal bore at one end to provide clearance for the strain gaged section of strain gage sub 18. A smaller seal bore is at the other end to allow passage of the load rod 14 and o-ring 17 seals the lower housing 15 against fluid intrusion. The load rod 14 is inserted through the bore and joined with threads to the strain gage sub 18, and functions to transfer external forces to the strain gage body. The internal cavity 42 containing the strain gages 35 is thus sealed and isolated from the external environment in contrast to the typical oil-filled systems. The internal cavity 42 contains air, but may alternatively contain dry nitrogen or any chemically inert gas.

Figure 3:
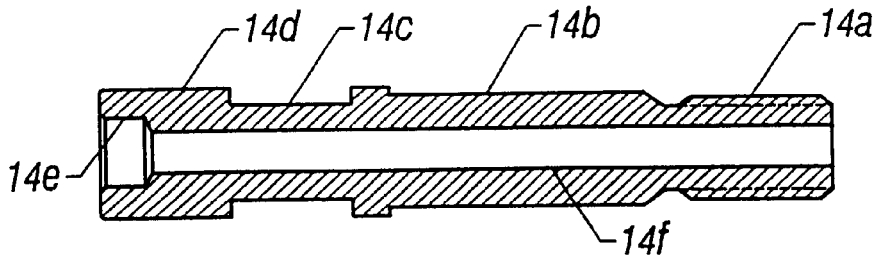
FIG. 3 shows a schematic diagram of a load rod according to one embodiment of the present invention.
Figure 4A:
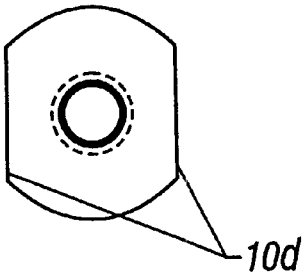
FIG. 4 show a schematic diagram of a seal body according to one embodiment of the present invention.
Figure 4B:
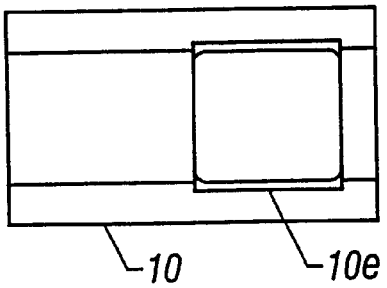
Figure 4C:
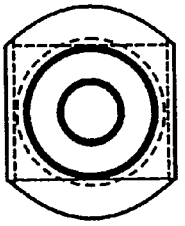
Figure 4D:
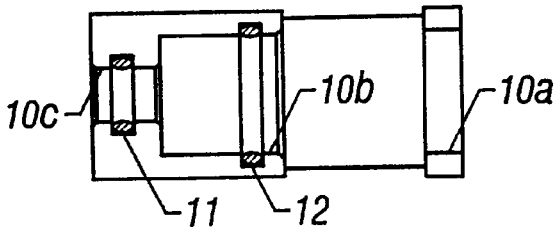

The load rod 14, is configured with features critical to functional performance, as shown in FIG. 2 and FIG. 3. The thread 14*a* is provided and suitably designed to connect the load rod 14 to the strain gage sub 18, and to withstand the applied external forces. The diameters 14*b* and 14*d* function as pressure sealing surfaces, and are also designed and proportioned to effect a balance of hydrostatic pressure forces applied to the load rod 14. The diameter 14*c* is sized to provide mechanical shoulders as a means to transfer the external tension and compression forces. The internal diameter 14*e* provides for mechanical clearance, and the diameter 14*f* provides passage for electrical wiring and optical fibers.

The seal body 10, (see FIG. 2 and FIG. 4) functions as an extension of the lower housing 15, and provides a seal for the upper end of the load rod 14 and the top sub 1. The critical design features of the seal body, shown in FIG. 4, are: the axial bores 10*a*, 10*b*, 10*c*, the two external parallel flats 10*d*, the two external windows 10*e* which are perpendicular to the two flats, and the o-rings 10*f* and 10*g*. The bore 10*a* is sized to clear the outside diameter of the pull rod. Together with the o-rings 10*f* and 10*g*, the bores 10*b* and 10*c* are proportioned to effect a pressure seal on the pull rod diameter 14*d* and the top sub diameter 1*d*, respectively. Parallel flats 10*d* and external windows 10*e* are proportioned and arranged to provide clearance for the tension links 13, and access to the load rod 14.

Figure 5:
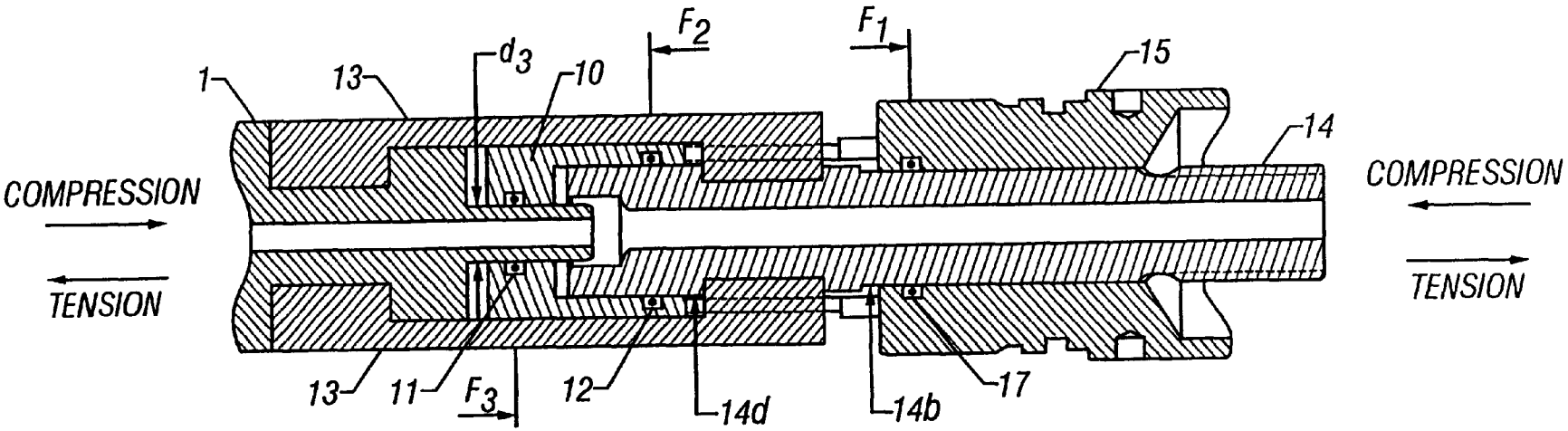
FIG. 5 shows a schematic diagram of the forces imposed on the load rod according to one embodiment of the present invention.

As a major point of novelty as compared to other systems, the bores and o-rings are proportioned and arranged to produce a balance of hydrostatic forces acting on the load rod 14, as shown in FIG. 5. It can be shown that, considered as a free body, the load rod 14 is affected by hydrostatic pressure force vectors F2, F1, and F3. For free body equilibrium along the central axis, force vector F2 must be equal to the sum of force vector F1 and force vector F3, but opposite in direction. The interactions of the seal body 10, the load rod 14, and the lower housing 15, cause the force vector F2 to oppose the force vector F1. To enable the summation of force vector F1 and force vector F3, a pair of tension links 13 are incorporated.

The tension links 13 are designed to pass through the windows 10*e* of the seal body 10 to engage the respective shoulders on the load rod 14, and top sub 1. This is shown in FIG. 2 and FIG. 5. The load rod 14 is thus maintained in a state of hydrostatic equilibrium.

The pair of tensile links 13 are suitably proportioned to transmit the force vector F3 and the external tension and/or compression force vectors. With the force vector F3 applied, the load rod 14 is maintained in a state of hydrostatic equilibrium, and only the tension and/or compression force vectors are transmitted to the strain gage sub 18.

In addition to the primary function, (to monitor and quantify the external tension and/or compression forces), the strain gage sub 18 is a structural member of the instrument.

Referring to FIG. 2, the upper housing 9 slides over the top sub 1 and the tension links 13 and threads into the lower housing 15. As shown in FIG. 2, the inner diameter of upper housing 9 constrains the tension link 13 to remain engaged in the notches in the seal body 10 and in the top sub 1. In FIG. 2, anti-rotation pin 8 fits through elongated slot, in the upper housing 9 and screws into top sub 1, preventing rotation of the top sub 1 relative to the strain gage sub 18. This prevents torque loading of the load rod 14 and the strain gages 35 and allows measurement of only the tension and compression loads on the system. Split collars 2 clamp around top sub 1, as shown in FIG. 2, and are fastened together by screws (not shown) in threaded holes 3. The split collars 2 are adapted to mate with threads in the cable head 50. O-rings 4 seal out wellbore fluid. Electrical connector 6 is inserted in top sub 1 and provides for electrical and optical fiber connection with a similar connector in the cable head 50. Threaded pin 5 fastens the connector 6 in position in top sub 1 and seal 7 provides a seal against fluid intrusion.

Figure 6:
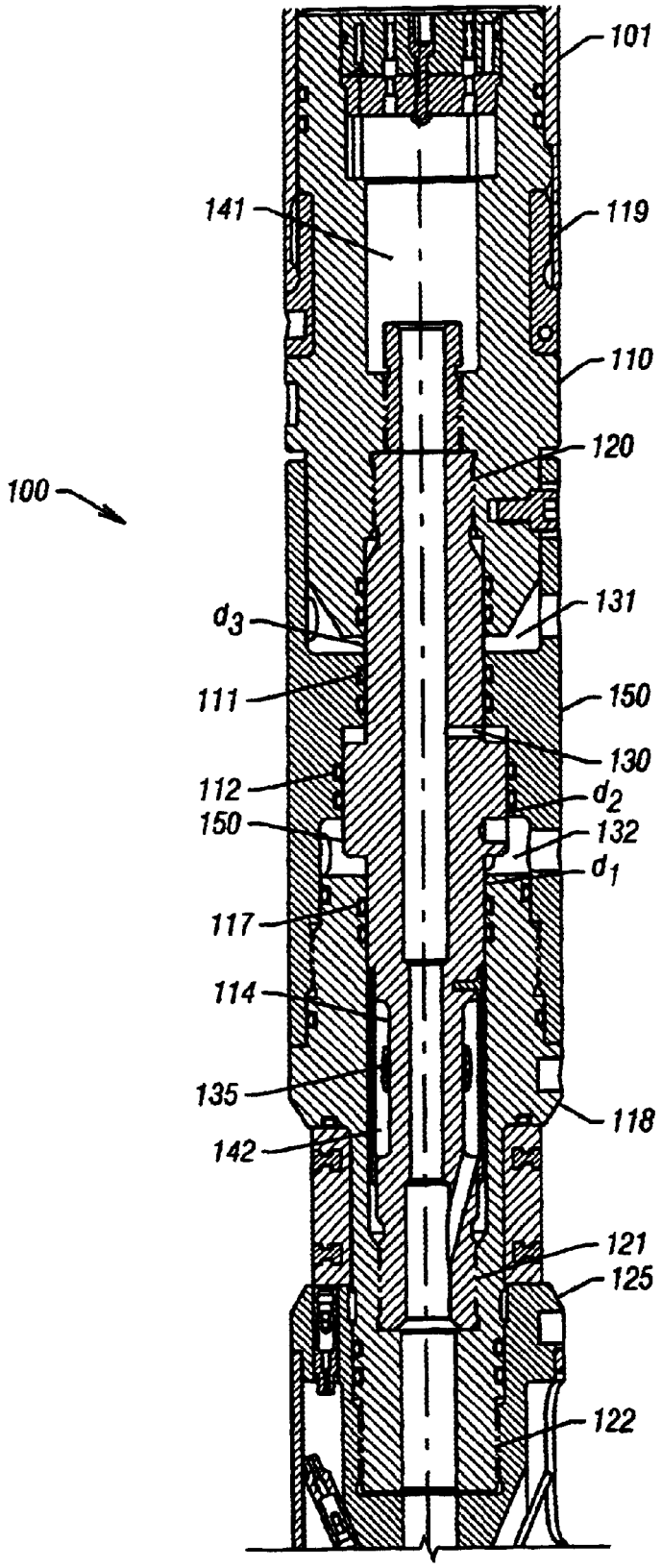
FIG. 6 is a schematic diagram of a load measuring tool according to one embodiment of the present invention.

FIG. 6 shows another preferred embodiment exhibiting significant improvements in manufacturing cost and ease of assembly as compared to the preferred embodiment of FIGS. 2–5. The seal body 10 and load links 13 of FIG. 2 are eliminated in the embodiment shown in FIG. 6. As shown in FIG. 6, load sensing tool 100 is connected to a wireline connection sub 101 through threaded connection 119, thereby, transferring the axial load to top sub 110. Alternatively, the load sensing tool 100 may be connected to coiled tubing (not shown). Both compression and tension loads can be transferred to load rod 114 through threaded connection 120. The load is transferred from load rod 114 to gage sub 118 and then to lower sub 125 through threaded connections 121 and 122, respectively. The lower sub 125 is connected to an instrument string (not shown). A compensating sub 150 is attached to the gage sub and stepped bores with seals 112 and 111 disposed on the inner circumference of the stepped bores. The bores and seals 111 and 112 are dimensioned to form a fluid seal with the load rod 114. The load rod 114 also forms a fluid seal with seal 117 disposed in gage sub 118. Cavities 131 and 132 are open to allow drilling fluid to enter the cavities 131 and 132.

The interior of the tool 100 is filled with a gas at atmospheric pressure in direct contrast to typical downhole load tools that are oil-filled. The gas-filled tool has significant advantages over oil-filled tools. The strain gages in the oil-filled tools are subjected to bottom hole pressure which induces an error signal related to bottom hole pressure in the tool output. In addition, the oil ages and in many cases attacks and degrades the strain gages and the bonding agent fixing the gages to the load member. The cavities 141 and 142 and the wireway 143 are gas-filled. Port 130 connects the gas atmosphere to the area between seals 111 and 112. The gas is typically air but may alternatively be dry nitrogen or an inert gas such as argon, helium, or the like.

Figure 7:
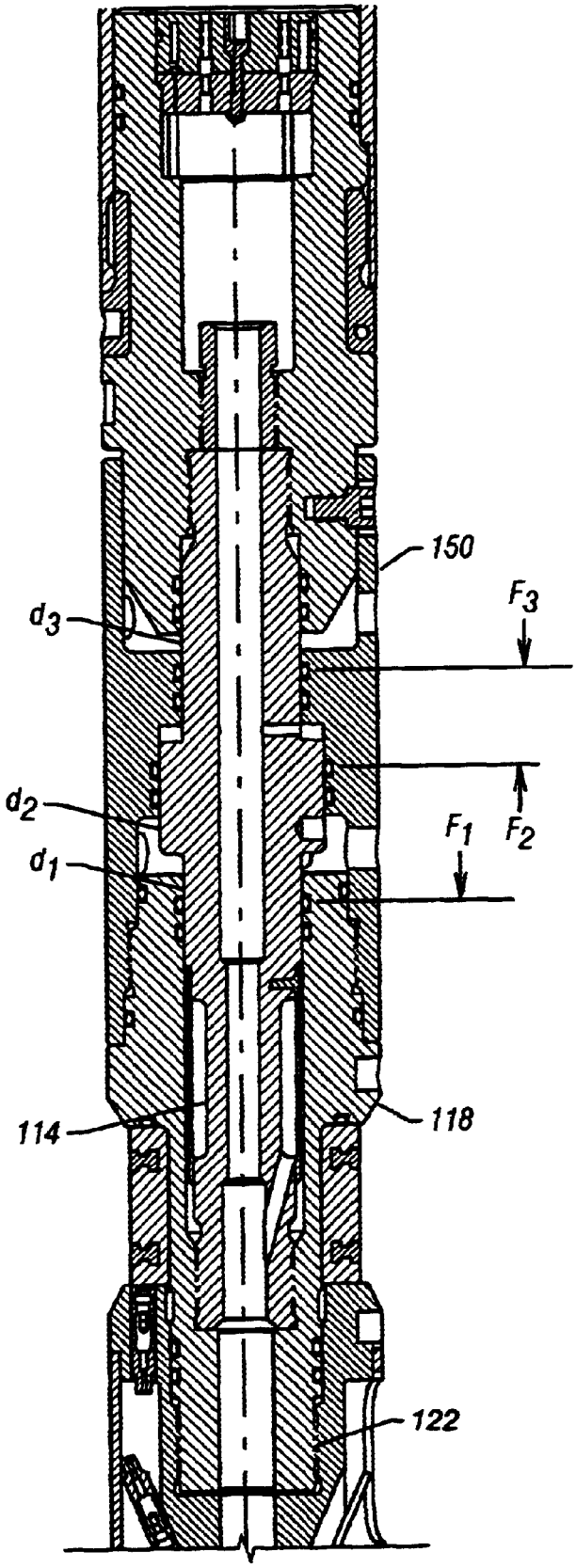
FIG. 7 is a schematic diagram showing the pressure induced loads acting on the load measuring tool of FIG. 6.

Prior art tools have not used a gas filled sensor because the bottom hole pressure results in an axial load on the load sensor which results in a downhole pressure related error in the measurement of deployment forces. As described previously, the present invention uses predetermined sealing diameters on the load rod to balance the axial pressure forces and essentially eliminate downhole pressure as a source of measurement error. As a major point of novelty as compared to other systems, the bores and o-rings are proportioned and arranged to produce a balance of hydrostatic forces acting on the load rod 114, as shown in FIG. 7. It can be shown that, considered as a free body, the load rod 114 is affected by hydrostatic pressure force vectors F2, F1, and F3. For free body equilibrium along the central axis, force vector F2 must be equal to the sum of force vector F1 and force vector F3, but opposite in direction. The interactions of the compensating sub 150, the load rod 114, and the gage housing 118, cause the force vector F2 to oppose the force vector F1. The forces are balanced when the sealed area defined by d3 is equal to the difference in the areas defined by d2 and d1. The downhole pressure acting on these areas cause the load rod 114 to be in static equilibrium.

Strain gages 135 are disposed on the load rod 114 for sensing axial deployment loads transferred through the load rod 114. The instrumented load rod 114 provides for easy replacement should the load rod 114 and/or strain gages 135 be damaged. The gages 135 maybe bonded strain gages or vapor deposited gages known in the art. As the deployment loads are imposed on the load rod 114, it experiences elastic strain, related to the load, that is detected by the strain gages 135.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

What is claimed is:

1. An apparatus for measuring the deployment forces acting on a well logging instrument string, comprising:

a load rod adapted to be connected between a deployment system and the well logging instrument string, said load rod transferring the deployment forces between the deployment system and the logging instrument string;

a strain gage system disposed on the load rod for indicating the deployment forces on the instrument string;

a housing adapted to fit sealably over the load rod, said housing providing a pressure sealed, gas filled, cavity surrounding the load rod; and a pressure balancing system for essentially eliminating the effects of downhole pressure on the load rod, the pressure balancing system comprising a first sealing diameter, a second sealing diameter, and a third sealing diameter, said diameters selected such that the sealing area defined by the first sealing diameter is equal to the difference in the areas defined by the second sealing diameter and the third sealing diameter.

2. The apparatus of claim 1, wherein the strain gage system comprises a plurality of individual strain gages, said gages adapted to be adhesively bonded to the load rod.

3. The apparatus of claim 1, wherein the strain gage system comprises a plurality of individual strain gages, said gages being disposed on the sensing member by vacuum deposition.

4. The apparatus of claim 2, wherein the gas filled cavity is filled with one of (i) atmospheric pressure air, (ii) dry nitrogen, and (iii) an inert gas.

5. A method of measuring deployment forces on a well logging instrument string comprising;

connecting a load rod between a deployment system and the instrument string;

using a strain gage system disposed on the load rod for indicating the forces on the instrument string;

providing a housing adapted to fit sealably over the load rod, said housing providing a pressure sealed, gas filled, cavity surrounding the load rod; and essentially eliminating the effects of downhole pressure on the load rod by using a difference in sealed areas on the load rod to balance the downhole pressure induced forces on the load rod.

6. A method of measuring deployment forces on a well logging instrument string comprising;

connecting a load rod between a deployment system and the instrument string;

using a strain gage system disposed on the load rod for indicating the forces on the instrument string;

providing a housing adapted to fit sealably over the load rod, said housing providing a pressure sealed, gas filled, cavity surrounding the load rod; and essentially eliminating the effects of downhole pressure on the load rod by selecting a first sealing diameter, a second sealing diameter, and a third sealing diameter, said diameters selected such that the sealing area defined by the first sealing diameter is equal to the difference in the areas defined by the second sealing diameter and the third sealing diameter.

* * * * *